US007013787B2

(12) United States Patent
Shimizu

(10) Patent No.: US 7,013,787 B2
(45) Date of Patent: Mar. 21, 2006

(54) BRAIDING COMPOSITION BACKING USING WIDE YARN AND MANUFACTURING METHOD THEREOF

(75) Inventor: Ryo Shimizu, Uji (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 0 days.

(21) Appl. No.: 10/808,909

(22) Filed: Mar. 25, 2004

(65) Prior Publication Data

US 2004/0237760 A1 Dec. 2, 2004

(30) Foreign Application Priority Data

May 30, 2003 (JP) ..... 2003-153851

(51) Int. Cl.
*D04C 1/02* (2006.01)

(52) U.S. Cl. ..... 87/8; 87/11

(58) Field of Classification Search ..... 87/8, 87/9, 11, 33, 34

See application file for complete search history.

(56) References Cited

U.S. PATENT DOCUMENTS 5,899,134 A * 5/1999 Klein et al. ..... 87/9
6,112,634 A * 9/2000 Head ..... 87/13
6,128,998 A * 10/2000 Freitas et al. ..... 87/8
2002/0069750 A1 * 6/2002 Uchida et al. ..... 87/33

FOREIGN PATENT DOCUMENTS

JP 2000-130584 11/2001

* cited by examiner

*Primary Examiner*—Danny Worrell
*Assistant Examiner*—Shaun R. Hurley
(74) *Attorney, Agent, or Firm*—Hodgson Russ LLP

(57) ABSTRACT

A pair of braiding threads 11, 12 and having braiding angle ±θ° to the axis of the mandrel are composed of wide yarns WY having a band shape with a wide width, and the wide yarns are braided around the mandrel without any gap in the width direction to form a cylindrical braiding layer 15 so that the resulting layer is cut in the axis direction of the mandrel to be formed into sheets; thus, a braiding composition backing is formed by these sheets. The objective of the present invention is to provide a braiding composition backing made of thin, uniform braiding layers that are formed by braiding wide yarns having a band shape with a wide width (prepreg slit yarns) around a mandrel without any gap.

4 Claims, 6 Drawing Sheets

A $$\text{Yarn windth } w = \frac{D}{\dfrac{\text{Total number of carriers}}{2}}$$

B

BRAIDING COMPOSITION BACKING USING WIDE YARN AND MANUFACTURING METHOD THEREOF

BACKGROUND OF THE INVENTION

1. Field of the Invention

This invention relates to fiber fabric formed by braiding carbon threads or fiber reinforced plastics (hereinafter, referred to as FRP), etc. that have been impregnated with resin by using a braider device, and more particularly concerns a braiding composition backing formed by braiding wide threads having a band shape with a wide width (prepreg slit yarn).

2. Prior Art

Conventionally, with respect to manufacturing processes for fiber fabric by braiding, a technique disclosed in Patent Document 1 has been known. In the manufacturing methods for fiber fabric for FRP and for prepreg for FRP described in this Patent Document 1, a plurality of diagonal threads S are supplied from a diagonal thread supplying part 3 to form a cylinder-shaped fabric 4 on the peripheral surface of the mandrel 1 so that the cylindrical fabric 4 is cut in the axial direction of the mandrel 1; thus, a long fabric 5 in which diagonal threads S are arranged is manufactured.

In the invention disclosed in the above-mentioned Patent Document 1, a thread having a round shape in its cross section (traprepreg yarn) is used as the diagonal thread S. In such a braiding manufacturing method by the use of a thread with a round shape in its cross section, it is not possible to obtain a thin, uniform braiding composition backing. In other words, in this conventional braiding manufacturing method, a plurality of braiding layers need to be superposed in an attempt to form a uniform braiding layer, resulting in an increased thickness to fail to provide a thin, uniform braiding composition backing.

Patent Document 1: Japanese Patent Application Laid-Open No. 2001-310393.

Patent Document 2: Japanese Patent Application Laid-Open No. 2002-249961.

SUMMARY OF THE INVENTION

This invention has been devised to solve the above-mentioned conventional problem, and its objective is to provide a braiding composition backing made of a thin, uniform braiding layer by braiding a wide yarn (prepreg slit yarn) having a band shape with a wide width on a mandrel without any gap. Moreover, this invention also provides a manufacturing method which is also made applicable to a mandrel with a larger diameter by changing only the width of the wide yarn without the necessity of changing the number of plaited threads, and makes it possible to effectively manufacture a sheet-shaped braiding composition backing with a wide width.

In order to achieve the above-mentioned objective, this invention is more specifically provided with processes in which: a pair of braiding threads having braiding angle ±θ° to the axis of the mandrel are composed of wide yarns having a band shape with a wide width, and the wide yarns are braided around a mandrel without any gap in the width direction to form a cylindrical braiding layer so that the resulting layer is cut in the axial direction of the mandrel to be formed into sheets; thus, the braiding composition backing using a wide yarn is formed by these sheets.

In this invention, the braiding composition backing using a wide yarn has an arrangement in which: the braiding layer is composed of a pair of braiding threads having braiding angle ±θ° to the axis of the mandrel and a center thread having braiding angle 0° to the axis, with the braiding threads and the center thread being composed of wide yarns having a band shape with a wide width.

Further, in this invention, the braiding composition backing using a wide yarn has an arrangement in which: the braiding layer is formed by arranging a filling thread with a pair of plaited threads having braiding angle ±θ° to the axis of the mandrel.

Moreover, this invention also relates to a manufacturing method for a braiding composition backing using a wide yarn that is provided with the steps of: by using wide yarns having a band shape with a wide width released and supplied from N number of bobbin carriers, as a pair of braiding threads having braiding angle ±θ° to the axis of the mandrel, braiding the yarns without any gap in the width direction to form a cylindrical braiding layer; and cutting the cylindrical braiding layer open in the axial direction of the mandrel to form the braiding composition backing having a sheet shape.

BRIEF DESCRIPTION OF THE DRAWINGS

FIG. 2A is a schematic perspective view that shows a cylindrical braiding layer that is formed into a cylinder shape around a mandrel;

FIG. 2B is a schematic perspective view that shows a state in which the layer is cut in the axial direction of the mandrel to form a sheet-shaped braiding composition backing;

FIG. 3A is an explanatory drawing that explains that, in the case of a comparatively large braiding angle θ, the width dimension w of the wide yarn is set to a comparatively large width w1;

FIG. 3B is an explanatory drawing that explains that, in the case of a comparatively small braiding angle θ, the width dimension w of the wide yarn is set to a comparatively large width w2;

FIG. 4A is a schematic plan view that shows a braiding composition backing in accordance with a first example which is composed of a pair of braiding threads having braiding angle ±θ°;

FIG. 4B is a schematic plan view that shows a braiding composition backing in accordance with a second example in which the braiding layer is formed by arranging a filling thread with a pair of braiding threads having braiding angle ±θ°;

FIG. 4C is a schematic plan view that shows a braiding composition backing in accordance with a third example in which the braiding layer is formed by arranging a pair of braiding threads having braiding angle ±θ° with a axial thread.

DESCRIPTION OF THE PREFERRED EMBODIMENTS

Figure 5:
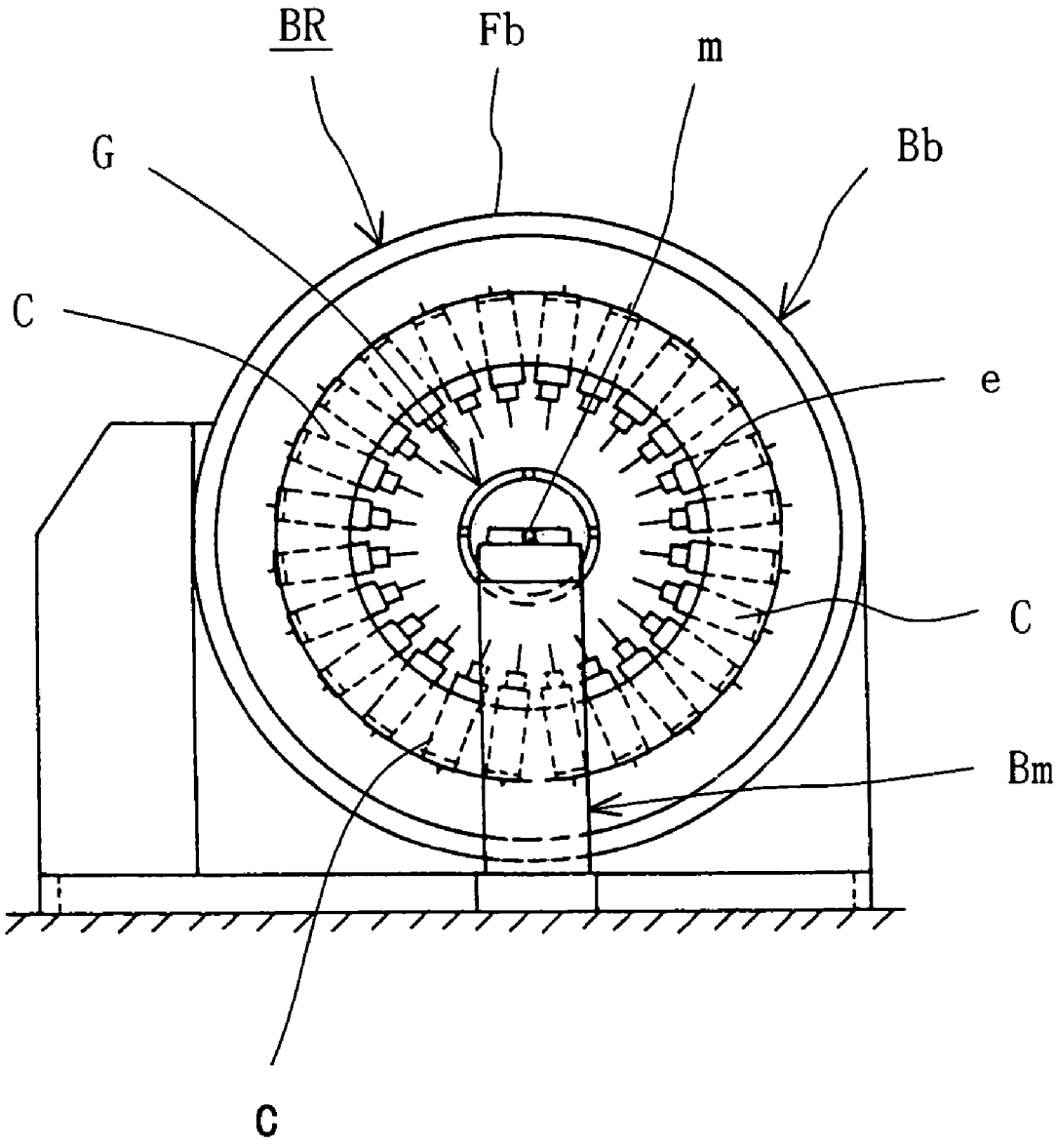
FIG. 5 is a schematic front view that shows one example of a basic structure of a braider devise.
Figure 6:
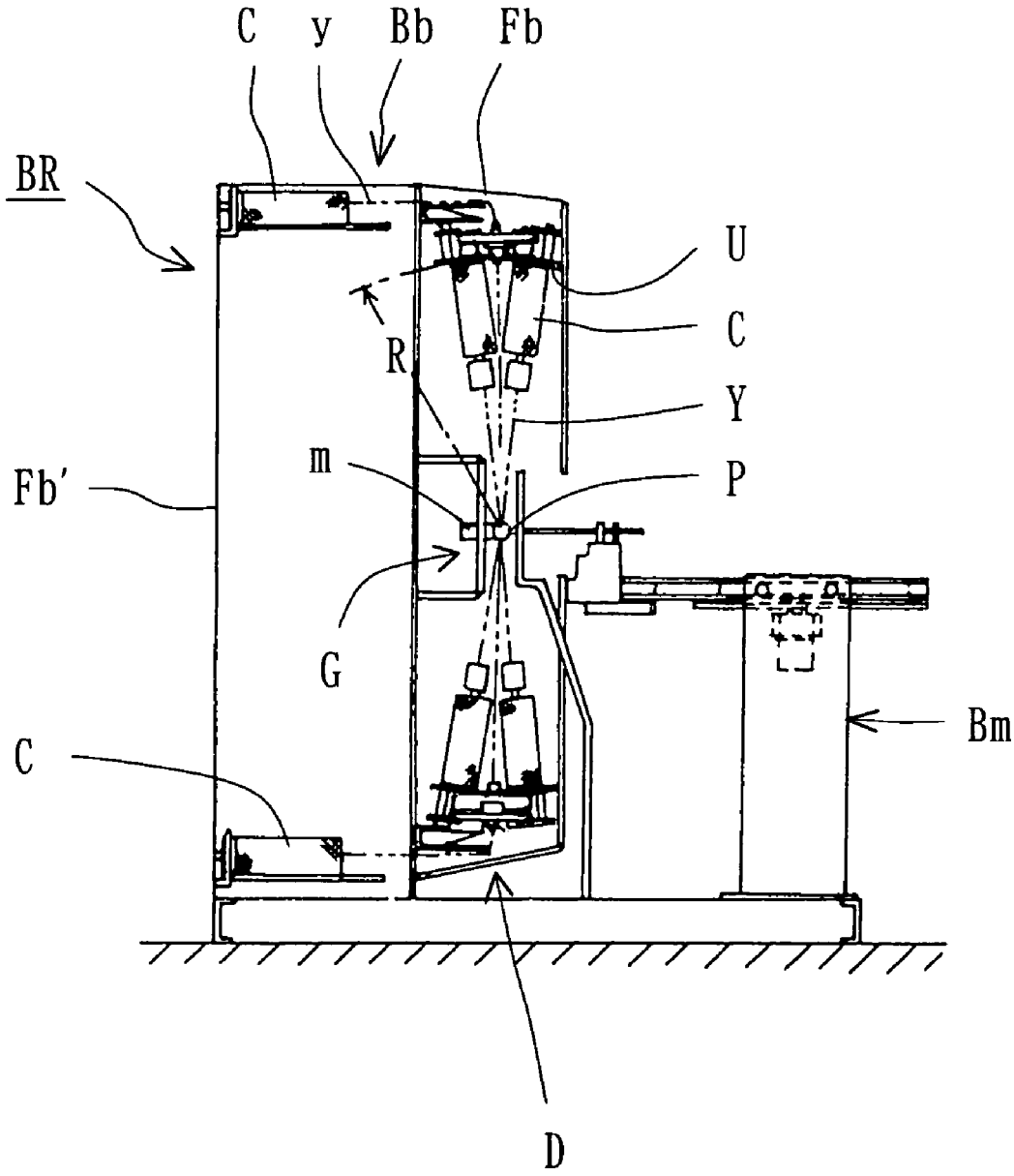
FIG. 6 is a schematic cross-sectional side view that shows the braider device shown in FIG. 5.

Based upon specific embodiments shown in Figures, the following description will discuss a braiding composition backing using a wide yarn and a manufacturing method thereof in detail. Referring to FIGS. 5 and 6, the following description will discuss the braider used for forming the braiding composition backing using a wide yarn in accordance with the present invention in detail. In the example shown in these Figures, a braider device BR is constituted by a braider main body Bb and a mandrel device Bm.

The braider main body Bb in the braider device BR is provided with an upper plate U having a curved face with a curvature of radius R that is placed in a cylinder-shaped machine base Fb having a horizontal axis line with an opening e on one end, a bobbin carrier C that travels along a track formed in the upper plate U in the circumferential direction, a driving device D used for driving the bobbin carrier C along the track and a thread guiding device G.

Thus, thread Y, drawn from bobbins placed in the bobbin carrier C in the bobbin axial direction, are gathered virtually in the center of the upper plate U, and the position of a mandrel m attached to the mandrel device Bm is set in such a manner that a subject material to be formed on the mandrel m has a braiding point P that is centered on the upper plate U. The mandrel device Bm controls the position of the mandrel m to be placed one-dimensionally, two-dimensionally or three-dimensionally.

In this manner, the position of the mandrel m is controlled by the mandrel device Bm while the bobbin carrier C is allowed to travel along the track by the driving device D, with the result that a number of thread Y are allowed to intersect one another, and that, if necessary, a thread y having braiding angle 0°, released from the bobbin carrier C placed horizontally on the frame Fb' of the machine base Fb, is entangled with the thread Y that are rewound from the bobbin carrier C traveling along the track and braided together; thus, braiding processes are carried out to form braided fabric layers on mandrels m having various shapes.

Figure 1:
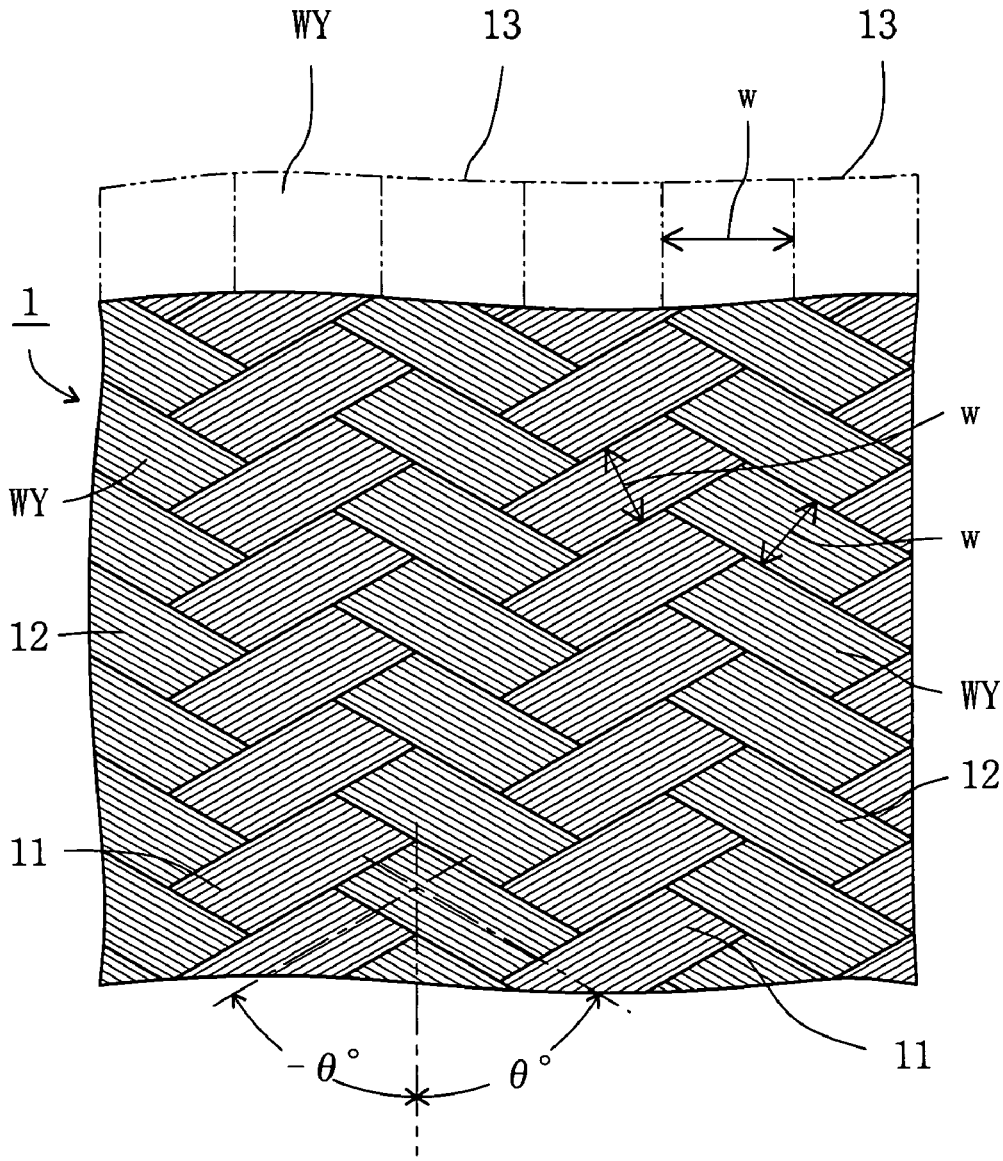
FIG. 1 is a schematic plan view that shows one example of a braiding composition backing using a wide yarn in accordance with this invention.
Figure 2:
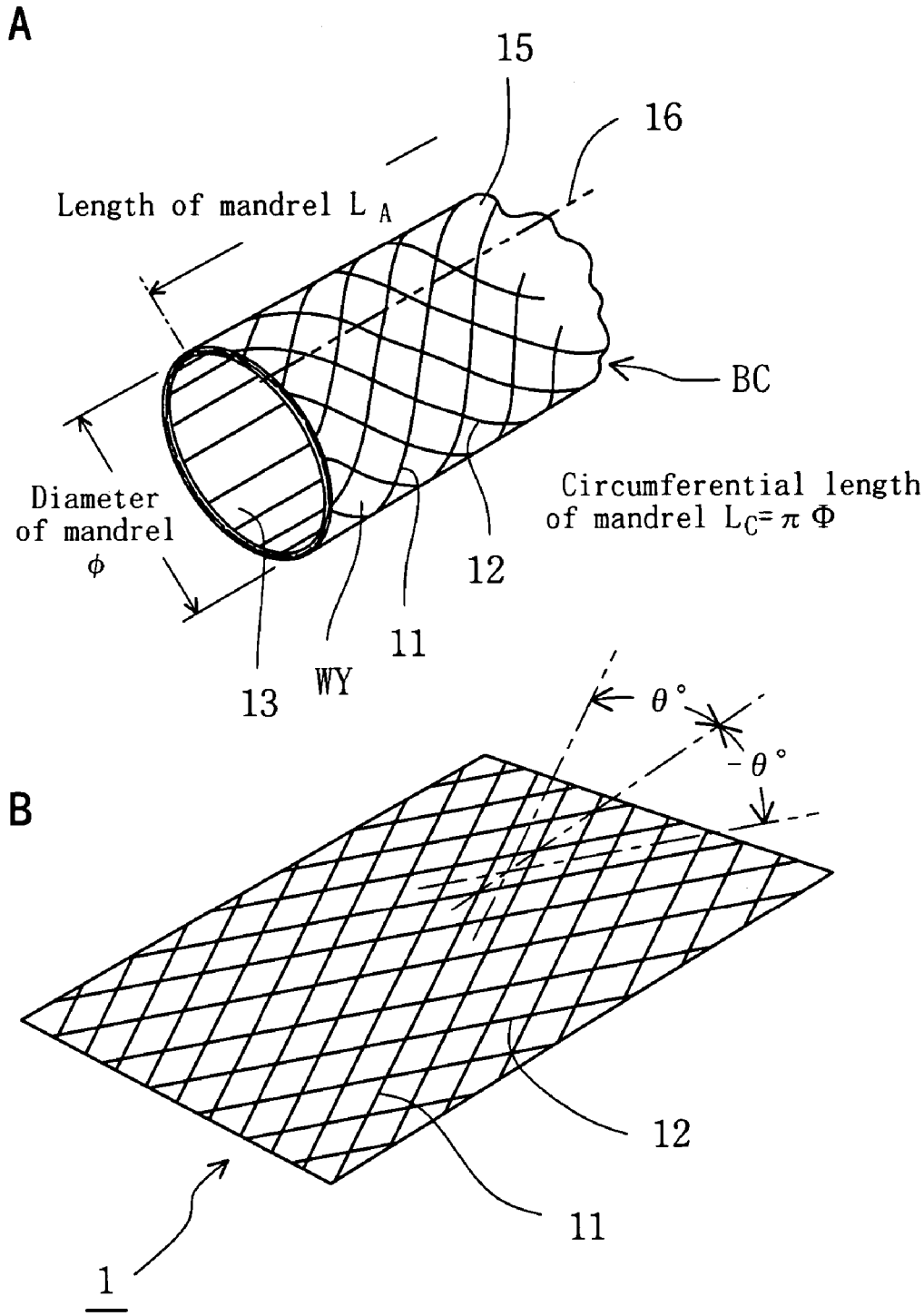
FIG. 2 is a drawing that explains a sequence of manufacturing processes of the braiding composition backing in accordance with the present invention.

Next, referring to FIG. 2, the following description will discuss a basic structural example of a braiding composition formed by the above-mentioned braider. A braiding composition BC shown in FIG. 2 is formed as a cylindrical (pipe-shaped) braided matter. In an example shown in FIG. 2A, the above-mentioned braiding composition BC is composed of a pair of braiding threads 11, 12 having braiding angle ±θ° to the axis and an axial thread 13 having braiding angle 0° to the axis.

First, with respect to one embodiment of the present invention, the following description will discuss a structural example of a pair of braiding threads 11 and 12 and an axial thread 13 to be used in the braider device BR so as to manufacture a braiding composition backing 1. In the present invention, the pair of braiding threads 11 and 12 and the axial thread 13 are composed of wide yarns WY, each having a band shape with a wide width, and the wide yarn WY is prepared by the following processes: for example, material threads, such as carbon threads, preliminarily impregnated with a resin, are combined in a plane shape to form a very thin sheet material, and this sheet material is subjected to a slitter process to form wide yarns WY having a width dimension w so that these are prepared as bobbins to be set in the braider device BR.

Figure 3:
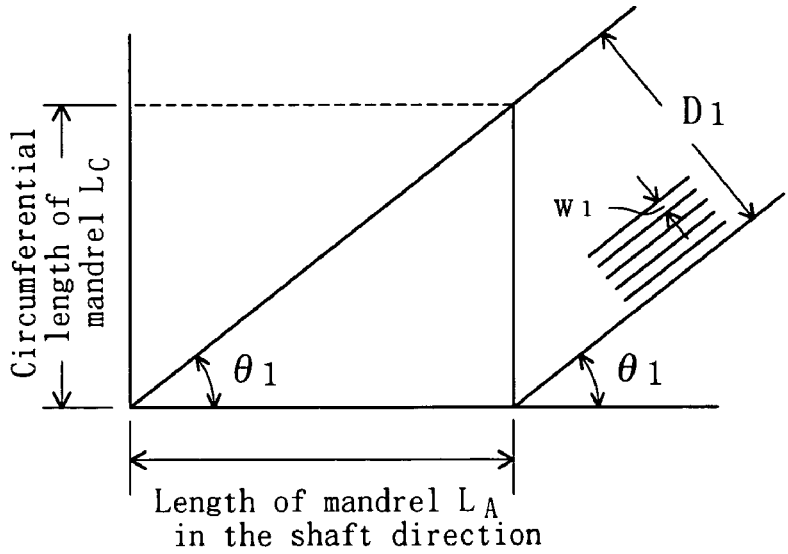
FIG. 3 explains a relationship between the width dimension w of a wide yarn and the braiding angle θ of braiding threads to be applied to the present invention.
Figure 3:
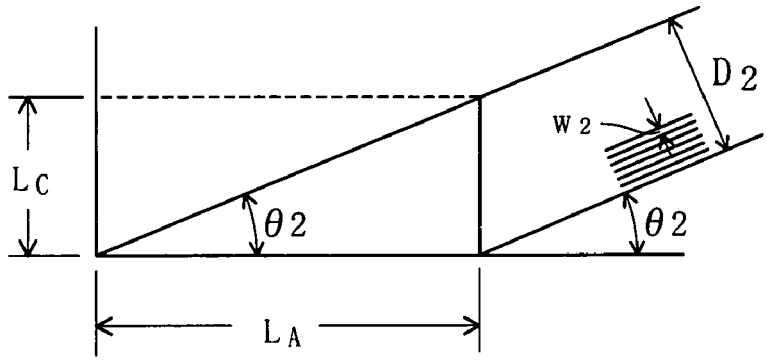

As shown in FIG. 3, the width dimension w of this wide yarn WY is designed as follows: First, as shown in FIG. 3, in the case when the axis of ordinates is set to the length dimension LC of the circumference of the mandrel m (circumferential length LC of the mandrel: LC=πφ with the diameter of the mandrel m being defined as φ) with the axis of abscissas being set to the axial direction dimension LA of the mandrel m, the braiding angle ±θ° of the braiding threads can be determined, and based upon this, the pitch-to-pitch distance D of braiding angle ±θ° can be obtained. In this invention, braiding threads (wide yarns WY) having braiding angles ±θ°, supplied from a plurality of carriers, are braided without any gap in the width direction so that the width dimension w of each of the wide yarns WY is calculated from the following equation: w=D/(total number of carriers/2).

As shown in FIG. 3A and FIG. 3B in comparison with each other, in the case when braiding angle θ of braiding threads is a comparatively large braiding angle θ1 as shown in FIG. 3A, based upon the pitch-to-pitch distance D1 of braiding angle ±θ1, the width dimension w of the wide yarn is calculated as a comparatively large width w1=D1/(total number of carriers/2), and in the case when braiding angle θ of braiding threads is a comparatively small braiding angle θ2 as shown in FIG. 3B, based upon the pitch-to-pitch distance D2 of braiding angle ±θ2, the width dimension w of the wide yarn is calculated as a comparatively small width w2=D2/(total number of carriers/2). In these embodiments, the pitch-to-pitch distance D1 of braiding angle ±θ1 means the following state: with braiding angle of a pair of braiding threads being set to the angle ±θ1, the braiding threads are one-pitch wound around the mandrel m over the circumferential length LC by the axial direction length LA of the mandrel m at the corresponding angle, and with respect to the pitch-to-pitch distance D1, within this distance, the wide yarns of width dimension w1 the number of which is the half the number of the total carriers are braided without any gap from each other. In the same manner, the pitch-to-pitch distance D2 of braiding angle ±θ2 means the following state: with braiding angle of a pair of braiding threads being set to the angle ±θ2, the braiding threads are one-pitch wound around the mandrel m over the circumferential length LC by the axial direction length LA of the mandrel m at the corresponding angle, and with respect to the distance to the next one-pitch winding process correspond to the pitch-to-pitch distance D2, within this distance, the wide yarns of width dimension w2 the number of which is the half the number of the total carriers are braided without any gap from each other. In the present invention, as described above, the braiding process is made applicable to a mandrel having a larger diameter, by changing only the width dimension w of the wide yarns WY, without the necessity of any change in the number of braiding threads.

Figure 4:
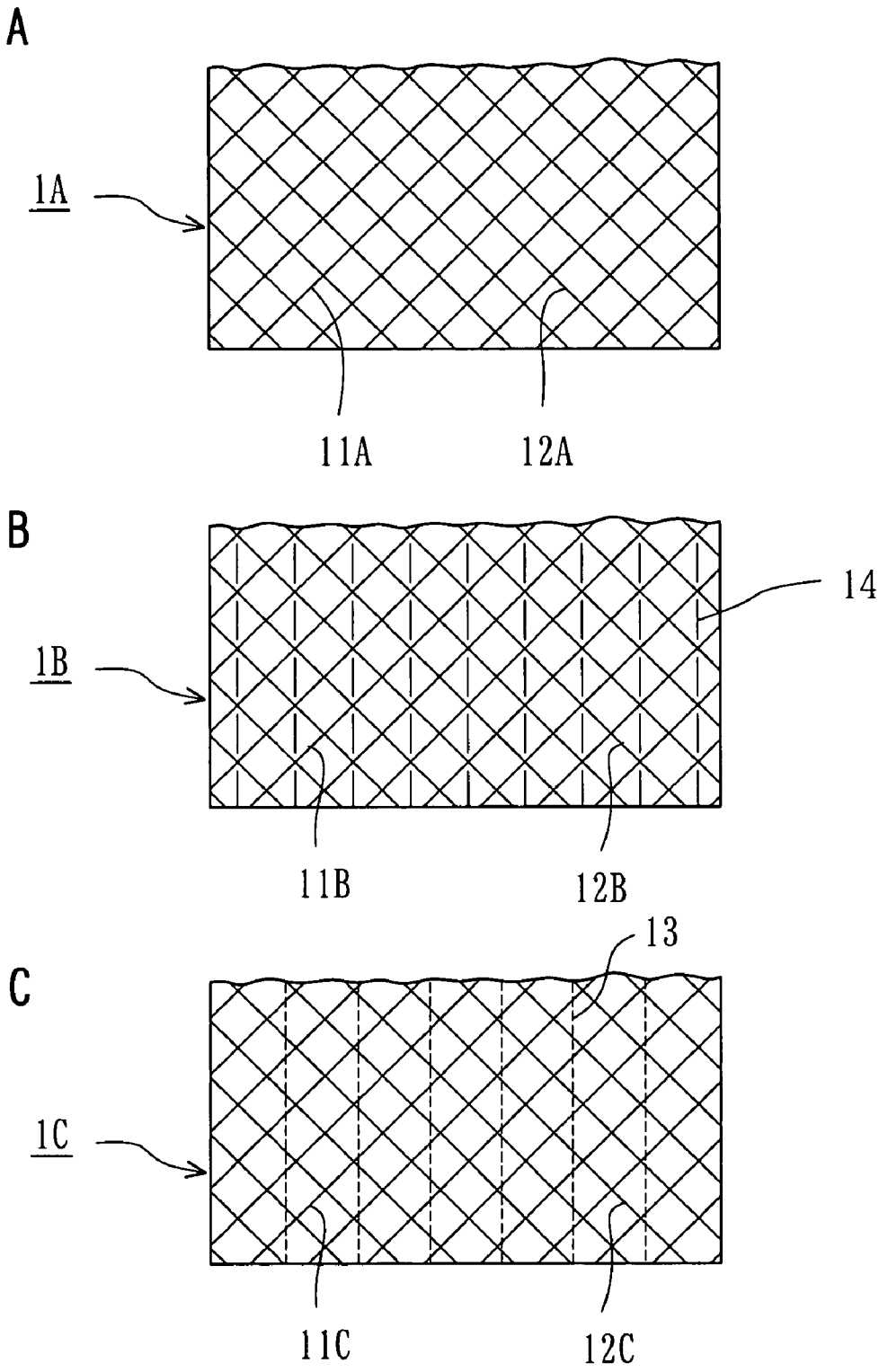
FIG. 4 shows a different structural example of a braiding composition backing in accordance with the present invention.

The braiding composition backing 1 of the present invention may have different composition structures as shown in the respective drawings of FIG. 4. As shown in FIG. 4A, a braiding composition backing 1A in accordance with a first example is constituted by only a pair of braiding threads 11A and 12A having braiding angle ±θ°, as shown in FIG. 4B, a braiding composition backing 1B in accordance with a second example is constituted by a pair of braiding threads 11B and 12B having braiding angle ±θ° with which a filling thread 14 is arranged, and as shown in FIG. 4C, a braiding composition backing 1C in accordance with a third example is constituted by a pair of braiding threads 11C and 12C having braiding angle ±θ° with which an axial thread 13 is arranged. The filling thread 14, shown in FIG. 4B, is a thread used for stopping the pair of the braiding threads 11B and 12B braided through a braiding process, and this thread is treated through a process different from the braiding process.

The present invention also includes a manufacturing method used for manufacturing the braiding composition backing 1 using the wide yarn. The manufacturing method for the braiding composition backing 1 of the present invention includes: a processes in which by using a braider device, wide yarns WY having a band shape with a wide width, released and supplied from N number of bobbin carriers, as a pair of braiding threads 11 and 12 having braiding angle ±θ° to the axis of the mandrel m and an axial thread 13 having braiding angle 0° to the axis, the yarns are braided without any gap in the width direction to form a cylindrical braiding layer 15 (see FIG. 2A); and a process in which the cylindrical braiding layer 15 is cut along a cut line 16 that extends in the axial direction of the mandrel m so that a sheet-shaped braiding composition backing 1 is formed (see FIG. 2B).

In accordance with the braiding composition backing using a wide yarn and its manufacturing method of the present invention having the above-mentioned arrangements, wide threads having a band shape (prepreg slit yarns) are braided around the mandrel m without any gap so that it is possible to form a thin, uniform braiding composition backing in comparison with a conventional braided material using threads having a round shape in the cross section thereof. Moreover, in an attempt to form a uniform braiding composition backing without any gap by using determined set angle and mandrel diameter, a plurality of layers need to be superposed in the case of conventional threads having a round shape in the cross section thereof, resulting in an increased thickness to fail to provide a uniform, thin backing; however, the present invention makes it possible to solve this problem. Moreover, the method of this invention is also made applicable to a mandrel with a larger diameter by changing only the width of the band without the necessity of changing the number of plaited threads. Furthermore, in this invention, band-shaped threads aligned in the axial direction of the mandrel, which are referred to as axial threads, are braided together so that it is possible to form a thin, uniform FRP backing. Since the braiding composition backing of this invention is thin and uniform, it is possible to form a structure with a uniform thickness even when multiple layers are superposed.

What is claimed is:

1. A braiding composition backing using a wide yarn, wherein pairs of first braiding threads extending parallel to each other, and having braiding angle +θ° to the axis of the mandrel, and second braiding threads extending parallel to each other, and having braiding angle −0° to the axis of the mandrel are composed of wide yarns having a band shape with a wide width, and the wide yarns are braided around the mandrel, and disposed continuously with each other in the width direction without any gap in the width direction to form a cylindrical braiding layer so that the resulting layer is cut in the axial direction of the mandrel to be formed into sheets to form the braiding composition backing.

2. The braiding composition backing using a wide yarn according to claim 1, wherein the braiding layer is composed of pairs of braiding threads having braiding angle ±θ° to the axis of the mandrel and an axial thread having braiding angle 0° to the axis, with the braiding threads and the axial thread being composed of wide yarns having a band shape with a wide width.

3. The braiding composition backing using a wide yarn according to claim 1, wherein the braiding layer is formed by arranging a filling thread with a pair of braiding threads having braiding angle ±θ° to the axis of the mandrel.

4. A manufacturing method for a braiding composition backing using a wide yarn comprising the steps of:

by using wide yarns having a band shape with a wide width, released and supplied from N number of bobbin carriers, as pairs of first braiding threads extending parallel to each other, and having braiding angle +θ° to the axis of the mandrel, and second braiding threads extending parallel to each other, and having braiding angle −θ° to the axis of the mandrel, braiding the yarns disposed continuously with each other in the width direction without any gap in the width direction to form a cylindrical braiding layer; and cutting the cylindrical braiding layer open in the axis direction of the mandrel to form the braiding composition backing having a sheet shape.

* * * * *